US009739571B2

(12) United States Patent
Winker et al.

(10) Patent No.: US 9,739,571 B2
(45) Date of Patent: Aug. 22, 2017

(54) MOVING OBJECT COMMAND LINK SYSTEM AND METHOD

(71) Applicant: TELEDYNE SCIENTIFIC & IMAGING, LLC, Thousand Oaks, CA (US)

(72) Inventors: Bruce Winker, Ventura, CA (US); Milind Mahajan, Thousand Oaks, CA (US); Don Taber, Newbury Park, CA (US); Brian Gregory, Newbury Park, CA (US); John Mansell, Thousand Oaks, CA (US)

(73) Assignee: TELEDYNE SCIENTIFIC & IMAGING, LLC, Thousand Oaks, CA (US)

( * ) Notice: Subject to any disclaimer, the term of this patent is extended or adjusted under 35 U.S.C. 154(b) by 362 days.

(21) Appl. No.: 14/590,627

(22) Filed: Jan. 6, 2015

(65) Prior Publication Data

US 2016/0195365 A1 Jul. 7, 2016

(51) Int. Cl.
*F41G 7/30* (2006.01)
*F41G 7/00* (2006.01)

(52) U.S. Cl.
CPC ..... *F41G 7/306* (2013.01); *F41G 7/001* (2013.01); *F41G 7/308* (2013.01)

(58) Field of Classification Search
CPC ... F41G 7/20; F41G 7/30; F41G 7/301; F41G 7/306; F41G 7/308; F41G 7/001; F41G 7/24; F41G 7/26; F41G 7/263; F41G 7/266; G01S 7/48; G01S 7/499; G02B 5/18; G02B 5/1828
USPC ..... 342/62
See application file for complete search history.

(56) References Cited

U.S. PATENT DOCUMENTS 3,594,085 A 7/1971 Wilmanns ..... 356/114
3,751,166 A * 8/1973 Starkey ..... F41G 7/30 244/3.16
3,995,792 A * 12/1976 Otto ..... F41G 7/30 244/3.13

(Continued)

FOREIGN PATENT DOCUMENTS

EP 0151480 A3 * 9/1985 ..... F41G 7/30
FR 2525339 A1 * 10/1983 ..... F41G 7/30

(Continued)

*Primary Examiner* — Bernarr Gregory
(74) *Attorney, Agent, or Firm* — Koppel, Patrick, Heybl & Philpott

(57) ABSTRACT

A moving object command link system includes a transmitter which outputs a EM beam and a steering mechanism which directs the beam toward one or more objects, at least one of which is moving. The system may include a variable attenuator which modulates the average output power of the beam, and/or a divergence controller to maintain a desired beam size. The beam may be polarized, and the system may include a polarization modulator which changes the beam's polarization in accordance with a predetermined sequence and schedule. The system may include a 1×2 switch to selectively provide the beam to one of first and second outputs. A tiltable dichroic beam splitter may be used to couple beams received from first and second objects to track cameras having respective boresights that are offset with respect to each other.

44 Claims, 3 Drawing Sheets

(56) References Cited

U.S. PATENT DOCUMENTS

| | | | | | |
|---|---|---|---|---|---|
| 4,018,405 | A | * | 4/1977 | Baker | F41G 7/30 244/3.14 |
| 4,097,007 | A | | 6/1978 | Fagan et al. | 244/3.11 |
| 4,256,368 | A | | 3/1981 | Task | 350/408 |
| 4,318,591 | A | | 3/1982 | Elterman | 350/374 |
| 4,327,966 | A | * | 5/1982 | Bloom | G02B 5/1828 250/505.1 |
| 4,406,430 | A | * | 9/1983 | Krammer | F41G 7/26 244/3.13 |
| 4,520,362 | A | | 5/1985 | Charlot | 343/361 |
| 4,530,600 | A | * | 7/1985 | Lopez | G01S 7/499 356/5.14 |
| 5,007,692 | A | | 4/1991 | Matsuura | 350/6.8 |
| 5,042,951 | A | | 8/1991 | Gold et al. | 356/369 |
| 5,159,396 | A | | 10/1992 | Yuhas | 356/28.5 |
| 5,200,606 | A | | 4/1993 | Krasutsky et al. | 250/216 |
| 5,218,582 | A | | 6/1993 | Marchant | 369/14 |
| 5,272,351 | A | | 12/1993 | Andressen | 250/561 |
| 5,344,099 | A | | 9/1994 | Pittman et al. | 244/3.13 |
| 5,574,479 | A | | 11/1996 | Odell | 345/158 |
| 5,757,671 | A | | 5/1998 | Drevillon et al. | 364/525 |
| 6,268,944 | B1 | | 7/2001 | Szapiel | 359/159 |
| 6,347,001 | B1 | | 2/2002 | Arnold et al. | 359/159 |
| 6,681,081 | B2 | | 1/2004 | Mao | 398/147 |
| 6,741,341 | B2 | | 5/2004 | DeFlumere | 356/141.1 |
| 6,968,133 | B2 | | 11/2005 | Sakanaka | 398/122 |
| 7,680,516 | B2 | | 3/2010 | Lovberg et al. | 455/562.1 |
| 8,009,292 | B2 | | 8/2011 | Choi et al. | 356/369 |
| 8,169,612 | B2 | | 5/2012 | Gao | 356/369 |
| 2004/0200947 | A1 | | 10/2004 | Lau | 250/202 |
| 2004/0208602 | A1 | | 10/2004 | Plante | 398/140 |
| 2005/0271125 | A1 | | 12/2005 | Chedester et al. | 375/219 |
| 2006/0192961 | A1 | | 8/2006 | Smith et al. | 356/364 |
| 2008/0316463 | A1 | | 12/2008 | Okada et al. | 356/4.01 |
| 2009/0285583 | A1 | | 11/2009 | Winker et al. | 398/152 |
| 2010/0052981 | A1 | | 3/2010 | Alexander et al. | 342/357.06 |
| 2010/0328644 | A1 | | 12/2010 | Lu et al. | 356/5.01 |

FOREIGN PATENT DOCUMENTS

| | | | | | |
|---|---|---|---|---|---|
| FR | 2547405 | A2 | * | 12/1984 | F41G 7/30 |
| FR | 2729748 | A2 | * | 7/1996 | F41G 7/30 |
| FR | 2848362 | A1 | * | 6/2004 | F41G 7/301 |
| IE | FR 2881821 | A1 | * | 8/2006 | F41G 7/266 |

* cited by examiner

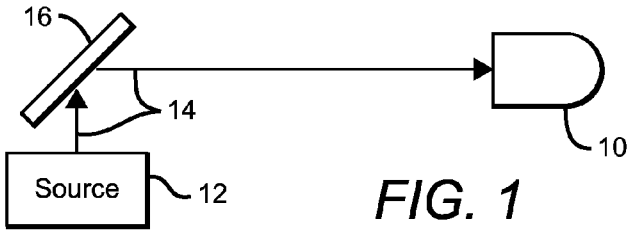
FIG. 1
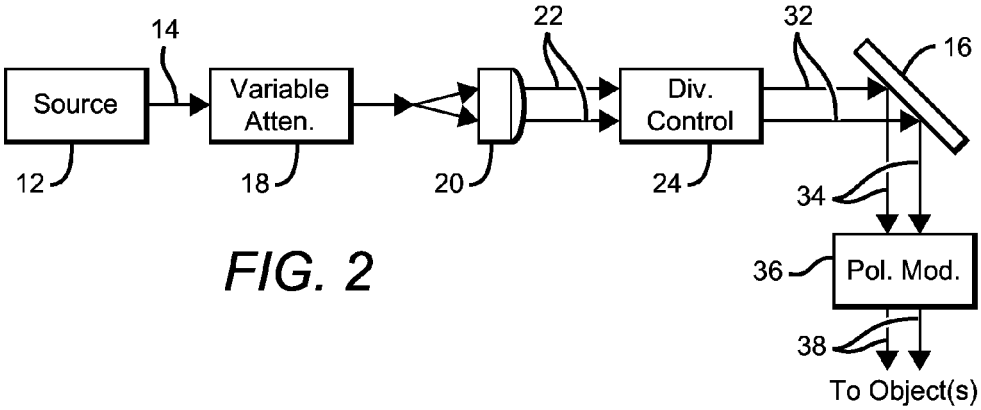
FIG. 2
FIG. 3
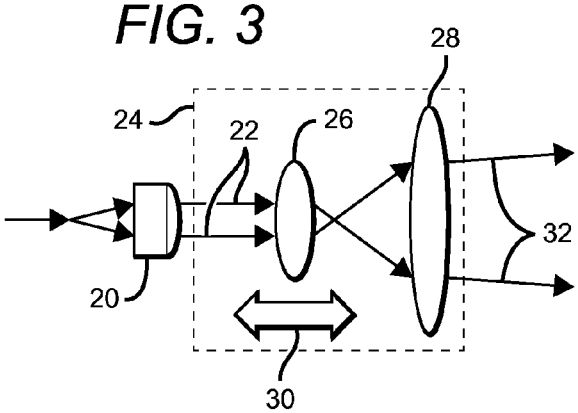
FIG. 4
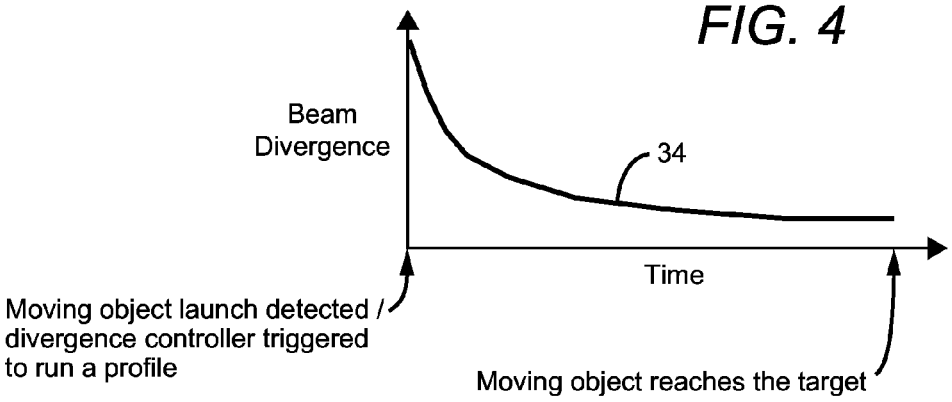

FIG. 8a
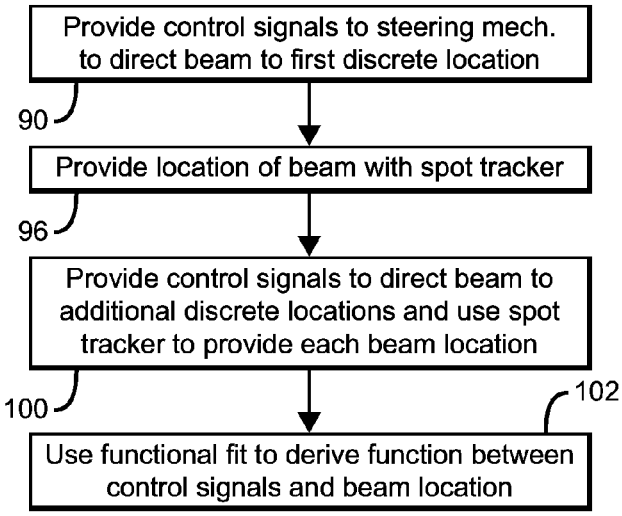
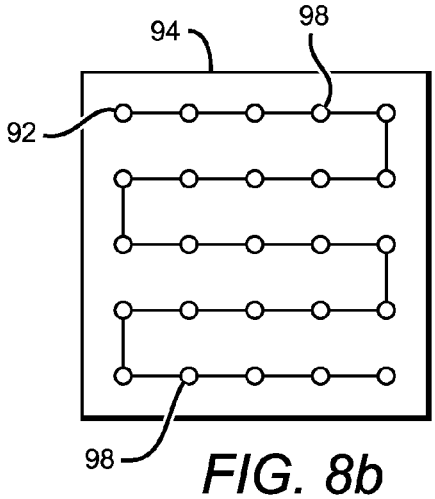
FIG. 8b
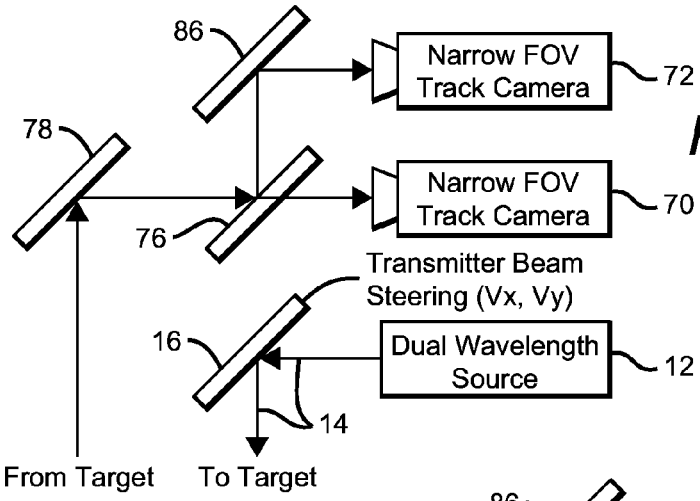
FIG. 9
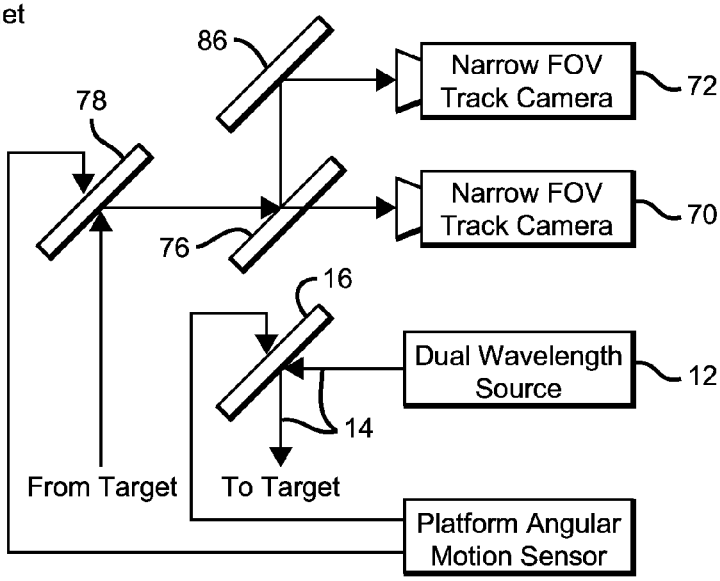
FIG. 10

MOVING OBJECT COMMAND LINK SYSTEM AND METHOD

GOVERNMENT RIGHTS

This invention was made with Government support under Department of Defense contract HR0011-09-C-0016. The Government has certain rights in this invention.

BACKGROUND OF THE INVENTION

Field of the Invention

This invention relates generally to systems for providing a command link between a transmitter and a moving object.

Description of the Related Art

It is often necessary to convey information between a transmitter and a moving object. For example, guidance data might need to be provided to a moving object such as a guided projectile. In such cases, it is necessary to establish a 'command link' between a transmitter which may be stationary or moving, and the moving object. However, a receiver on a moving object is likely to have a small dynamic range (<25 dB), while the transmitted data may be subject to large dynamic range variations due to, for example, atmospheric conditions and rapid change in the distance between the transmitter and the moving objects. This can make it difficult to establish and maintain a command link with a sufficient signal-to-noise ratio (SNR).

SUMMARY OF THE INVENTION

A moving object command link system and method is presented which addresses several of the problems noted above.

The present system is for creating a command link between a transmitter and one or more objects, at least one of which is moving and capable of receiving commands via a free space link. The system includes a source which outputs a beam of electromagnetic (EM) radiation, and a steering mechanism arranged to direct the EM beam toward one or more of the objects. The beam may be a pulsed laser beam, or another form of EM radiation such as RF. The system may include a variable attenuator arranged to modulate the average output power of the beam, and/or a divergence controller arranged to maintain a desired beam size at the at least one moving object. The divergence controller may include a storage means into which a divergence profile is loaded which represents a desired beam size over time.

When the transmitted beam is a laser, the system can include a detector, an array of detectors, and/or a camera arranged to receive light reflected from the at least one moving object. Then, a variable optical attenuator (VOA) can be used to modulate the average output power of the laser beam based on the brightness of the reflected light.

The transmitted beam may be linearly polarized, and the system may further include a polarization modulator which operates to change the polarization of the EM beam in accordance with a predetermined sequence and schedule.

The system can be arranged to track multiple objects, at least one of which is moving. For example, a 1×2 switch may be employed to selectively provide the beam to one of first and second outputs, with first and second object tracking mirrors coupled to receive the outputs and to direct them toward first and second objects, respectively.

The system may further include first and second object track cameras having respective boresights that are offset with respect to each other, and a dichroic beam splitter.

Beams sent or reflected from the first and second objects are directed to the dichroic beam splitter, which couples them to the first and second object track cameras, respectively. The dichroic beam splitter is preferably tiltable, with the system arranged to adjust the tilt as needed to accommodate an angular offset between the first and second object beams. The dichroic beam splitter is preferably further arranged to transmit incoming light that is within a first spectral band to the first object track camera and to reflect incoming light that is within a second spectral band to the second object track camera. Means of calibrating the system, and of suppressing platform disturbance, are also described.

These and other features, aspects, and advantages of the present invention will become better understood with reference to the following drawings, description, and claims.

BRIEF DESCRIPTION OF THE DRAWINGS

FIG. 1 is a block diagram illustrating a basic moving object command link system in accordance with the present invention.

FIG. 2 is a block diagram illustrating the several features of a transmitter for a moving object command link system in accordance with the present invention.

FIG. 3 is a diagram illustrating one possible embodiment of a divergence controller as might be used with a moving object command link system in accordance with the present invention.

FIG. 4 is a diagram illustrating one possible divergence profile as might be used with a moving object command link system in accordance with the present invention.

FIGS. 8*a* and 8*b* are flow and block diagrams, respectively, illustrating one possible calibration method for a moving object command link system in accordance with the present invention.

FIG. 9 is a block diagram illustrating another possible calibration method for a moving object command link system in accordance with the present invention.

FIG. 10 is a block diagram illustrating one possible platform disturbance suppression method for a moving object command link system in accordance with the present invention.

DETAILED DESCRIPTION OF THE INVENTION

Figure 5:
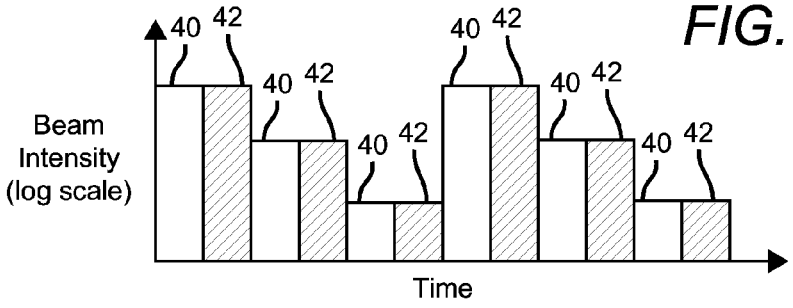
FIG. 5 is a diagram illustrating the operation of amplitude and polarization modulation on a transmitted beam as might be used with a moving object command link system in accordance with the present invention.

A basic system for creating a command link between a transmitter and one or more objects, at least one of which is moving, is shown in FIG. 1. The system includes at least one moving object 10, such as a guided projectile, which is capable of receiving commands via a free space link. A source 12 outputs a beam of electromagnetic (EM) radiation 14, and a steering mechanism 16, such as a mirror, directs the beam toward one or more of the objects. When source 12 and moving object 10 are properly configured, a free space command link can be created between them. The command link may be used to, for example, enable the moving object to be tracked and/or instructed to take some action. For example, the system can be arranged to encode guidance commands into the EM beam, with the moving object arranged to detect, decode and execute the encoded commands.

However, as noted above, a number of problems are inherent in such a system. For example, the receiver on moving object 10 is likely to have a limited dynamic range (<25 dB), while the transmitted data may be subject to large dynamic range variations due to, for example, atmospheric conditions and rapid change in distance between the transmitter and receiver. This can make it difficult to maintain a command link with a sufficient signal-to-noise ratio (SNR). The present system provides a number of ways in which these problems and others may be addressed, such that the accuracy and reliability of the command link is improved.

The components shown in FIG. 2 make up a transmitter as might be used with the present system. Source 12 can be a source of any type of EM radiation 14, including, for example, an RF beam or a laser beam; a pulsed laser beam is preferred. The system may include a variable attenuator 18 arranged to modulate the average output power of beam 14, which may be coupled to the variable attenuator via free space or optical fiber. The object with which a command link is to be created (not shown in FIG. 2) has a receiver for detecting the transmitted beam. The variable attenuator may be operated as needed to ensure that the amplitude of the beam received at the receiver is at a suitable level. For example, the receiver typically has an associated noise floor and saturation level. Variable attenuator 18 would preferably be arranged to use amplitude modulation (AM) to modulate the output power of the transmitted beam such that the signal received by the receiver is above the receiver's noise floor and below its saturation level.

The moving object(s) are typically arranged to return a signal, typically via reflection, preferably using a retroreflector. The present system may include a detector, an array of detectors, and/or a camera arranged to receive the signal reflected from the moving object. The intensity of the reflected signal is indicative of the amplitude of the signal detected at the receiver. Thus, the variable attenuator may be arranged to modulate the average output power of beam 14 based on the intensity of the reflected signal, to ensure that the amplitude of the beam received at the receiver is at a suitable level. For example, when the generated beam 14 is a laser, variable attenuator 18 is a variable optical attenuator (VOA), which may be arranged to modulate the average output power of laser beam 14 based on the brightness of the reflected light-boosting the beam's power if the detected signal is too weak (i.e., below the receiver's noise floor), or reducing the beam's power if the detected signal is too strong (i.e., receiver is saturated).

The output of variable attenuator 18 is preferably coupled to a collimator 20 via free space or optical fiber, with the collimator output 22 coupled to a divergence controller 24 via free space. The collimator and divergence controller are arranged to maintain a desired beam size—preferably a fixed size—at the moving object on which the EM beam is directed. As the distance between the transmitter and the moving object changes over time, divergence controller 24 might be arranged to provide a beam at the moving object which has a size that varies with time, or a size that varies with distance.

One possible implementation of divergence controller 24 is shown in FIG. 3. In this exemplary embodiment, the divergence controller comprises a first lens 26 and a second lens 28, with at least one of the lenses being capable of being translated linearly with respect to the other lens. Here, lens 26 can be translated linearly (30), by means of, for example, an actuator (not shown), and its position reported by means of, for example, an encoder (not shown). The divergence controller produces an output beam 32, the divergence of which is a function of the linear position of first lens 26 with respect to second lens 28. Note that other telescopic arrangements could also be used. Collimator 20, which may be motor-driven, may be a part of divergence controller 24, or a separate component as shown in FIGS. 2 and 3.

Divergence controller 24 might also include a storage means (not shown) into which a divergence profile is loaded which represents a desired beam size over time. The divergence controller would be operated in response to the divergence profile to control the divergence of the EM beam over time so as to maintain the beam at an approximately fixed size at the moving object as it travels away from the transmitter. The profile would typically be based on distance, and might additionally be based on the geometry of the trajectory of the moving object. An encoder and an actuator reporting and controlling the position of lens 30, respectively, could be operated in a closed loop to execute the stored divergence profile.

An example of such a divergence profile is illustrated in FIG. 4. The divergence profile 34 would typically be triggered when the moving object is initially put into motion or 'launched' (t=0). The detection of t=0 could be accomplished with, for example, an accelerometer affixed to the launching device. For example, the moving object could be a projectile that is launched with a gun; an accelerometer mounted to the gun could be used to detect its firing. Time t=0 might also be detected using devices such as a microphone or an optical muzzle flash detector, which need not be mounted directly on the gun. As noted above, a typical divergence profile would be designed to maintain a constant beam diameter on the moving object as it travels away from the transmitter.

Another approach could be to have the EM beam go from wider to narrower as the moving object travels away from the transmitter. By being wider when the moving object is first launched, acquisition of the beam by a receiver on the moving object is made easier. A wider beam can also help to prevent saturation of the receiver.

Referring back to FIG. 2, the output 32 from divergence controller 24 is directed toward steering mechanism 16, which directs the beam toward the one or more objects, at least one of which is moving. If the EM beam is a polarized beam, linearly polarized, for example, the output 34 from steering mechanism 16 might be directed to a polarization modulator 36 which operates to change the polarization of the beam 38 directed toward the moving object in accordance with a predetermined sequence and schedule. For example, the predetermined sequence/schedule could specify that polarization modulator 36 output an EM beam 38 with an initial 'base' polarization, and then direct the polarization modulator to alter the polarization of beam 38 in accordance with the sequence/schedule.

In some applications, a receiver on the moving object may include a phase-locked-loop (PLL) circuit. For example, some systems may be arranged to track the rotational orientation of the moving object using, for example, an ellipsometric detector capable of detecting a polarized EM beam generated by source 12. The ellipsometric detector is arranged to measure the polarization state of the detected beam, which is used to indicate the rotational orientation of the moving object with respect to the predefined coordinate system. An example of such a system is described in co-pending U.S. patent application Ser. No. 14/172,745. A PLL circuit (not shown) may be incorporated into a receiver on the moving object and used to track the object's rotational orientation and thereby mitigate any degradation in the accuracy of the rotational orientation determination that might otherwise occur if the polarized EM beam is disrupted.

However, the PLL circuit can work poorly if the object is not spinning or is spinning slowly. This issue can be addressed with the use of polarization modulation. As discussed above, the polarization modulator 36 would typically be arranged to alter the polarization of beam 38 in accordance with a sequence/schedule; this sequence/schedule would also be known by the receiver. Modulating the polarization in this way serves to improve the operation of the PLL and thereby the tracking of the object's rotational orientation.

Note that, as an alternative to having the polarization modulation sequence/schedule be known to the receiver, the system could be arranged such that the source encodes the polarization state of the beam in the transmitted beam itself; the receiver would then be arranged to decode the encoded polarization state.

The amplitude modulation (AM) that might be provided by a variable attenuator 18 and the polarization modulation that might be provided by polarization modulator 36 are illustrated in FIG. 5. In this example, beam intensity is modulated by variable attenuator 18 periodically over time. Polarization is modulated simultaneously by polarization modulator 36, with the transmitted beam having a first polarization—such as linear, vertical—during the first half 40 of the time that the beam is at a given amplitude, and having a second polarization—such as linear, tilted—during the second half 42 of the time that the beam is at the given amplitude.

AM is used to increase the dynamic range of the command link to make it tolerant to large signal fluctuations like those caused by large atmospheric turbulence. Transmitting the EM beam at multiple intensity levels as shown in FIG. 5 ensures that the signal is above the noise floor and below the saturation level of a receiver on the moving object for at least a portion of the transmission time, thereby enabling command link data to be detected under various atmospheric conditions. This, along with polarization modulation, can also help to maintain the PLL lock (if used), as a PLL is significantly more susceptible to saturation than the receiver detecting digital commands sent via the command link. The modulation frequency is preferably faster than the atmospheric dynamics.

Referring again to FIG. 2, steering mechanism 16 is preferably a steering mirror, the position of which is preferably controlled by means of a voice coil which is actuated in response to a control voltage. If it is required that an EM beam be directed to, for example, a first object and a second object, the system is arranged to provide control voltages to the steering mirror's voice coil as needed to direct the EM beam toward the first and second objects as desired.

Figure 6:
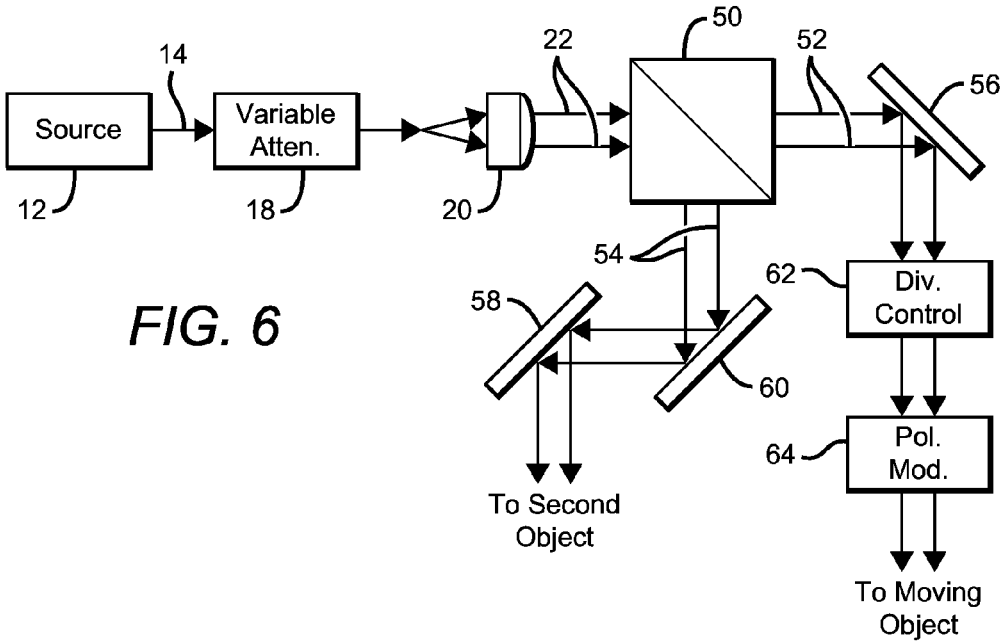
FIG. 6 is a block diagram illustrating the use of a 1×2 switch in a moving object command link system in accordance with the present invention.

A system configuration arranged to provide a command link to two objects, at least one of which is a moving object, is shown in FIG. 6. The system preferably includes a source 12, variable attenuator 18 and collimator 20 as described above, with the output 22 of the collimator provided to the input of a 1×2 switch 50, which selectively provides the collimator output to either a first output 52 or a second output 54. In this example, a first object tracking mirror 56 is coupled to receive first output 52 and direct it toward a moving object, and a second object tracking mirror 58 is coupled to receive second output 54 and direct it toward a second object. One or more additional mirrors, such as mirror 60, may be employed as needed to direct switch outputs 52 and 54 toward tracking mirrors 56 and 58. As discussed above, the beam directed toward the moving object may be manipulated using a divergence controller 62 to control the beam size, and a polarization modulator 64 to control the beam's polarization. Note that the positions of the divergence controller and the polarization modulator could be reversed, with no adverse effect on the system's functionality.

The moving object might be, for example, a projectile that is being guided using the command link, and the second object might be, for example, a target to which the projectile is being directed. In this case, the EM beam directed to the target object is not providing a command link to the target, but rather is used to track the position of the target. The use of 1×2 switch 50 and two separate tracking mirrors 56 and 58 allow the EM beam 14 generated by source 12 to be intermittently re-directed to the target object, to determine its range, for example. Depending on the particular application, the 1×2 switch could be toggled occasionally, on an as-needed basis, or made to toggle rapidly between its two outputs. Using a laser for beam 14 enables the target to be easily tracked at night. The positions of the tracking mirrors could be controlled by respective actuators and reported using respective encoders, such that their positions can be precisely controlled using respective closed loops, thereby enabling the directing of the 1×2 switch outputs toward the first and second objects to be maintained over time.

The configuration shown in FIG. 2 could also be used to track multiple objects, by directing steerable mechanism 16 so that beam 38 is directed back and forth between the multiple objects. However, this will result in 'blank time' for the system while beam 38 is being re-directed from one object to another. As such, the configuration shown in FIG. 6 is preferred, as it reduces the blank time.

Figure 7:
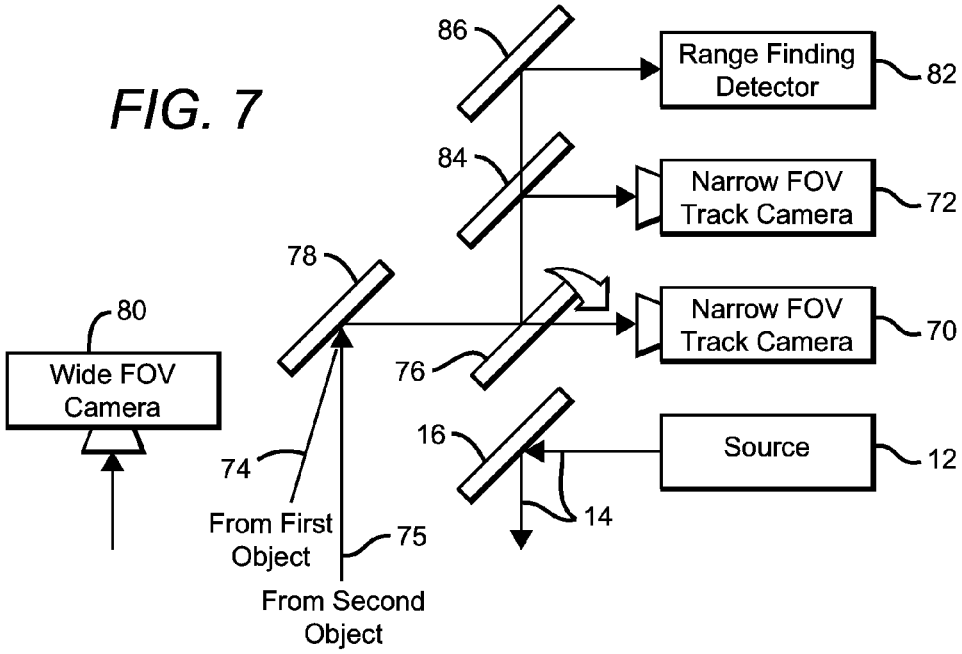
FIG. 7 is a block diagram illustrating the several features of a moving object command link system in accordance with the present invention.

Another possible system configuration is shown in FIG. 7, in which separate track cameras are used for two tracked objects. A first object track camera 70 is used for tracking a first object such as a target, and a second object track camera 72 is used for tracking a second object such as a guided projectile. The track cameras have respective 'boresights'—defined by the directions in which the central pixel in each camera is looking—that are offset with respect to each other, thereby enabling the system to track two objects that have large relative lateral speeds. Beams 74 and 75 returned or reflected from the first and second objects are directed to a dichroic beam splitter 76, preferably via a steerable mirror 78. The dichroic beam splitter 76 is preferably arranged to couple the first object beam and the second object beam to the first object track camera and the second object track camera, respectively.

In some applications, such as when the first and second objects are a target and a guided projectile, the angular spread between the objects at launch may be great. However, track cameras such as cameras 70 and 72 would typically have a high resolution and a narrow field-of-view (FOV), typically less than 6 degrees, which can make it difficult to acquire the objects they are to track. To address this issue, the system may include a wide FOV camera 80 with a field of view that is typically greater than 6 degrees, which enables a robust and early acquisition of one or both objects; the acquired positions can then be handed off to the track cameras. Early acquisition of the objects enables the command link to be established early in flight, with pointing of the transmitted beam maintained by wide FOV camera 80 well before the objects enter the FOVs of the track cameras. The system can be further arranged such that the position of steerable mirror 78 is at least in part controlled by wide FOV camera 80.

Dichroic beam splitter 76 is preferably tiltable, with the system arranged to adjust the tilt as needed to accommodate an angular offset between the first object beam and the second object beam. If the trajectories of the two objects become such that the angular separation between them exceeds the FOV of the track cameras, then the cameras need to be pointed at the objects separately so that acquisition of the objects is not lost. Tilting dichroic beam splitter 76 essentially allows second object track camera 72 to be pointed independently of first object track camera 70.

The dichroic beam splitter may be further arranged to transmit incoming light that is within a first spectral band to first object track camera 70, and to reflect incoming light that is within a second spectral band to second object track camera 72. When so arranged, two wavelengths, one of which may be a laser, can be used to communicate with and/or track the first and second objects. For example, an SWIR wavelength could be used to perform active tracking of a guided projectile tracked with second object track camera 72, and a VIS or NWIR wavelength could be used to perform passive tracking of a target tracked with first object track camera 70. This might be especially beneficial if tracking an object passively (i.e., without it being illuminated with a laser), in which case a shorter wavelength is preferred.

The system might further include a range finding detector 82. The range finding detector could be coupled to an output of dichroic beam splitter 76 via a beam splitter 84 and a mirror 86, with beam splitter 84 receiving the dichroic beam splitter output and conveying it to both second object track camera 72 and range finding detector 82 (via mirror 86). The range finding detector is preferably arranged to measure the ranges to both the first and second objects, which is accomplished by switching the source beam back and forth between the objects. If beam splitter 84 is steerable, it can have a narrower FOV than if fixed.

A system as described herein can be calibrated in a number of different ways. One method is illustrated in FIGS. 8*a* and 8*b*. The method assumes that the system includes a steering mechanism which directs an EM beam toward one or more objects in response to one or more control signals, a track camera having an associated field of view (FOV), and a spot tracker capable of providing the location of a beam within the camera's FOV. First, in step 90, control signals are provided to the steering mechanism such that the EM beam is directed at a first discrete location 92 within the track camera's FOV 94. The spot tracker is used to provide the location of the beam (step 96). Control signals are then provided to the steering mechanism such that the EM beam is directed at one or more additional discrete locations 98 within the track camera's FOV, with the spot tracker used to provide the locations of the beam after each set of control signals is provided (step 100). Finally, in step 102, a functional fit is used over the FOV to derive a function which relates the control signals provided to the steering mechanism with the beam locations provided by the spot tracker. The method can further comprise correcting the derived function for parallax errors. Once the function is derived, it can be used to generate the control signals necessary to point the transmitter in a desired direction during operation.

Another calibration method is illustrated in FIG. 9. The method employs track cameras 70 and 72, dichroic beam splitter 76, and mirrors 16, 78 and 86 discussed above. Source 12 is a dual-wavelength transmitter, arranged to output an EM beam having two wavelengths. Here, steerable mirror 16, which reflects the output of source 12 toward a target, is steered via control voltages Vx and Vy. An initial value of Vx and Vy is applied to steering mirror 16. The resulting beam is routed to dichroic beam splitter 76, which divides the beam by wavelength. Object track camera 70 receives and reports the x,y pixel location of the received beam having the first wavelength (Px1, Py1), and the second object track camera 72 receives and reports the x,y pixel location of the received beam having the second wavelength (Px2, Py2). This process is repeated for multiple values of Vx, Vy so as to obtain multiple Px1, Py1 and Px2, Py2 values.

Two set of functional fits are generated: one which correlates the Vx and Vy values to the multiple Px1, Py1 values, and one which correlates the Vx and Vy values to the multiple Px2, Py2 values. This enables the following relationships to be defined:

$$Vx=Fx1(Px1,Py1) \text{ and } Vy=Fy1(Px1,Py1), \text{ and}$$

$$Vx=Fx2(Px2,Py2) \text{ and } Vy=Fy2(Px2,Py2).$$

Once defined in this way, the transmitted beam can be directed to a given pixel location (Px1, Py1) at track camera 70 or a given pixel location (Px2, Py2) at track camera 72.

A system as configured in FIGS. 7 and 9 could also be used to suppress disturbances to the transmitter 'platform'—i.e., the structure to which the components shown in FIGS. 7 and 9 are attached—that could affect transmitter accuracy; this is illustrated in FIG. 10. An angular motion sensor (not shown) is mounted to the platform and provides an output which varies with the angular tip and tilt of the platform. The system is arranged to provide feedforward compensating control signals to steerable mirrors 16 and 78 based on the angular motion sensor output, to compensate for angular tip and tilt of the platform. In practice, platform disturbance is suppressed by providing compensating control signals that steer both mirrors in the direction opposite to the platform tip/tilt. The angular motion sensor could be, for example, gyroscopic sensors or an IMU.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

We claim:

1. A system for creating a command link between a transmitter and one or more objects, at least one of which is moving, comprising:

at least one moving object which is capable of receiving commands via a free space link;

a source which outputs a beam of electromagnetic radiation;

a steering mechanism arranged to direct said electromagnetic beam toward one or more of said objects;

a variable attenuator arranged to modulate the average output power of said beam to control the amplitude of the beam at said one or more objects; and a divergence controller arranged to maintain a desired beam size at said at least one moving object when said beam is directed on said object.

2. The system of claim 1, wherein said beam of electromagnetic radiation is a pulsed laser beam.

3. The system of claim 2, wherein said pulsed laser beam is generated by a source arranged to encode guidance commands into said beam, said at least one moving object arranged to detect and decode said pulses and thereby detect said guidance commands.

4. The system of claim 1, wherein said beam is coupled to said variable attenuator via free space or optical fiber.

5. The system of claim 1, wherein said divergence controller is arranged to maintain a beam of approximately fixed size at said at least one moving object.

6. The system of claim 1, wherein said divergence controller is arranged to provide a beam at said at least one moving object which has a size that varies with distance.

7. The system of claim 1, wherein said divergence controller comprises first and second lenses, at least one of said lenses capable of being translated linearly with respect to the other.

8. The system of claim 1, further comprising a receiver on said at least one moving object, said receiver arranged to detect said beam when said beam is directed toward said receiver.

9. The system of claim 1, wherein said beam is linearly polarized, said polarization being a base polarization.

10. The system of claim 1, further comprising at least one steering mirror arranged to direct said beam of electromagnetic radiation toward one or more of said objects as desired.

11. The system of claim 1, wherein at least one of said moving objects is put into motion at a time t=0 with a launching device, further comprising a means of detecting time t=0.

12. The system of claim 11, wherein said means of detecting time t=0 comprises an accelerometer mounted on said launching device.

13. The system of claim 11, wherein said means of detecting time t=0 comprises a microphone.

14. The system of claim 11, wherein said launching device is a firearm, and said means of detecting time t=0 comprises an optical muzzle flash detector.

15. A system for creating a command link between a transmitter and one or more objects, at least one of which is moving, comprising:

at least one moving object which is capable of receiving commands via a free space link;

a source which outputs a beam of electromagnetic radiation;

a steering mechanism arranged to direct said electromagnetic beam toward one or more of said objects; and a divergence controller arranged to maintain a desired beam size at said at least one moving object when said beam is directed on said object;

wherein said divergence controller is arranged to provide a beam at said at least one moving object which has a size that varies with time.

16. The system of claim 15, wherein said divergence controller includes a storage means into which a divergence profile is loaded which represents a desired beam size over time, said divergence controller operated in response to said divergence profile to control the divergence of said pulsed laser beam over time.

17. A system for creating a command link between a transmitter and one or more objects, at least one of which is moving, comprising:

at least one moving object which is capable of receiving commands via a free space link;

a source which outputs a beam of electromagnetic radiation;

a steering mechanism arranged to direct said electromagnetic beam toward one or more of said objects; and a receiver on said at least one moving object, said receiver arranged to detect said beam when said beam is directed toward said receiver; and a variable attenuator arranged to modulate the average output power of said beam, wherein said receiver has an associated noise floor and saturation level, said variable attenuator arranged to modulate the output power of said beam such that the signal received by said receiver is above said receiver's noise floor and below said receiver's saturation level.

18. The system of claim 17, wherein said beam of electromagnetic radiation is a pulsed laser beam and said variable attenuator is a variable optical attenuator (VOA), further comprising:

a detector, an array of detectors, and/or a camera arranged to receive light reflected from said at least one moving object;

said VOA arranged to modulate the average output power of said pulsed laser beam based on the brightness of said reflected light.

19. A system for creating a command link between a transmitter and one or more objects, at least one of which is moving, comprising:

at least one moving object which is capable of receiving commands via a free space link;

a source which outputs a beam of electromagnetic radiation, wherein said beam is linearly polarized, said polarization being a base polarization;

a steering mechanism arranged to direct said electromagnetic beam toward one or more of said objects; and a polarization modulator which operates to change the polarization of said beam directed toward said at least one moving object in accordance with a predetermined sequence and schedule.

20. The system of claim 19, further comprising a receiver on said at least one moving object, said receiver arranged to detect said beam when said beam is directed toward said receiver, said receiver arranged to process said detected beam in accordance with said predetermined sequence and schedule and to thereby detect said base polarization.

21. The system of claim 19, wherein said source is arranged to encode the polarization state of said beam in said beam.

22. A system for creating a command link between a transmitter and one or more objects, at least one of which is moving, comprising:

at least one moving object which is capable of receiving commands via a free space link;

a source which outputs a beam of electromagnetic radiation;

a steering mechanism arranged to direct said electromagnetic beam toward one or more of said objects; and at least one steering mirror arranged to direct said beam of electromagnetic radiation toward one or more of said objects as desired;

wherein said at least one steering mirror is directed by means of a voice coil which is actuated in response to a control voltage.

23. The system of claim 22, wherein said one or more objects comprise a first object and a second object, said system arranged to provide control voltages to said voice coil as needed to direct said beam of electromagnetic radiation toward said first and second objects as desired.

24. A system for creating a command link between a transmitter and one or more objects, at least one of which is moving, comprising:

at least one moving object which is capable of receiving commands via a free space link;

a source which outputs a beam of electromagnetic radiation, wherein said beam of electromagnetic radiation is a pulsed laser beam;

a steering mechanism arranged to direct said pulsed laser beam toward one or more of said objects; and a variable optical attenuator (VOA) arranged to modulate the average output power of said pulsed laser beam;

wherein said one or more objects comprise a first object and a second object, at least one of which is a moving object, further comprising:

a collimator coupled to the output of said VOA;

a 1×2 switch coupled to the output of said collimator at an input and which selectively provides said collimator output to one of first and second outputs;

a first object tracking mirror coupled to receive said first output of said 1×2 switch and to direct said output toward said first object;

a second object tracking mirror coupled to receive said second output of said 1×2 switch and to direct said output toward said second object.

25. The system of claim 24, wherein both of said first and second objects are moving, said first object being a guided object.

26. The system of claim 24, wherein the locations of said first and second objects are monitored, said system including first and second closed loops arranged to control said first and second object tracking mirrors such that the directing of said 1×2 switch outputs toward said first and second objects is maintained over time.

27. The system of claim 24, further comprising a divergence controller coupled to the output of said first object tracking mirror, said divergence controller arranged to maintain a beam of approximately fixed size at one of said at least one moving objects.

28. The system of claim 27, wherein said pulsed laser beam is linearly polarized, said polarization being a base polarization, further comprising a polarization modulator coupled to the output of said divergence controller and which operates to change the polarization of said divergence controller output in accordance with a predetermined sequence and schedule.

29. The system of claim 27, wherein said pulsed laser beam is linearly polarized, said polarization being a base polarization, further comprising a polarization modulator interposed between the output of said first object tracking mirror and said divergence controller and which operates to change the polarization of said divergence controller output in accordance with a predetermined sequence and schedule.

30. A system for creating a command link between a transmitter and one or more objects, at least one of which is moving, comprising:

at least one moving object which is capable of receiving commands via a free space link;

a source which outputs a beam of electromagnetic radiation, wherein said beam of electromagnetic radiation is a pulsed laser beam; and a steering mechanism arranged to direct said pulsed laser beam toward one or more of said objects;

wherein said at least one moving object comprises a retroreflector arranged to reflect said pulsed laser beam, said system further comprising a detector, an array of detectors, and/or a camera arranged to receive said reflected beam.

31. A system for creating a command link between a transmitter and one or more objects, at least one of which is moving, comprising:

at least one moving object which is capable of receiving commands via a free space link;

a source which outputs a beam of electromagnetic radiation, wherein said beam of electromagnetic radiation is a pulsed laser beam; and a steering mechanism arranged to direct said pulsed laser beam toward one or more of said objects;

wherein said one or more objects comprise a first object and a second object, said first object being a guided object, further comprising:

a first object track camera for tracking said first object;

a second object track camera for tracking said second object, said track cameras having respective boresights that are offset with respect to each other; and a dichroic beam splitter, said system arranged such that respective beams sent or reflected from said first object and said second object are directed to said dichroic beam splitter, said dichroic beam splitter arranged to couple said first object beam and said second object beam to said first object track camera and said second object track camera, respectively.

32. The system of claim 31, further comprising a first steerable mirror arranged to reflect said first and second object beams to said dichroic beam splitter.

33. The system of claim 32, further comprising a wide field-of-view (FOV) camera arranged to image said first and second objects, said system arranged such that the position of said steerable mirror is at least in part controlled by said wide FOV camera.

34. The system of claim 32, wherein said wide FOV camera has a FOV that is greater than 6 degrees and said first and second object track cameras have FOVs that are less than 6 degrees.

35. The system of claim 31, wherein said dichroic beam splitter is tiltable, said system arranged to adjust said tilt as needed to accommodate an angular offset between said first object beam and said second object beam.

36. The system of claim 35, said dichroic beam splitter arranged to transmit incoming light that is within a first spectral band to said first object track camera and to reflect incoming light that is within a second spectral band to said second object track camera.

37. The system of claim 36, wherein said source is arranged to output a laser beam having first and second wavelengths that are within said first and second spectral bands, respectively.

38. The system of claim 37, further comprising a steerable mirror arranged to reflect the output of said source.

39. The system of claim 38, wherein said second steerable mirror is steered via control voltages Vx and Vy;

wherein said first object track camera is arranged to report the x,y pixel location of said received beam having said first wavelength (Px1, Py1), and said second object track camera is arranged to report the x,y pixel location of said received beam having said second wavelength (Px2, Py2);

said system arranged to provide multiple values of Vx, Vy so as to obtain multiple Px1, Py1 and Px2, Py2 values;

further comprising a means of generating two sets of functional fits that correlate Vx and Vy to said multiple Px1, Py1 values and to said multiple Px2, Py2 values.

40. The system of claim 38, wherein said transmitter, said steerable mirrors, said dichroic beam splitter and said first and second object track cameras are mounted to a platform, further comprising an angular motion sensor mounted on said platform which provides an output that varies with the angular tip and tilt of said platform, said system arranged to provide compensating control signals to said first and second steerable mirrors based on said angular motion sensor output to compensate for said angular tip and tilt.

41. The system of claim 31, further comprising:

a range finding detector; and a beam splitter interposed between said dichroic beam splitter and said second object track camera and arranged to couple said first object beam received from said dichroic beam splitter to said first object track camera and to said range finding detector.

42. The system of claim 31, wherein said first and second object track cameras are narrow field-of-view (FOV) cameras.

43. A method of calibrating a system, said system arranged to create a command link between a transmitter and one or more objects, at least one of said one or more objects is moving, and which includes a source that outputs a beam of electromagnetic (EM) radiation, a steering mechanism which directs said EM beam toward one or more of said objects in response to one or more control signals, a track camera having an associated field of view (FOV), and a spot tracker capable of providing the location of a beam within said FOV, said method comprising:

providing control signals to said steering mechanism such that said EM beam is directed at a first discrete location within said track camera's FOV;

using said spot tracker to provide the location of said beam;

providing control signals to said steering mechanism such that said EM beam is directed at one or more additional discrete locations within said track camera's FOV;

using said spot tracker to provide the locations of said beam after each set of control signals is provided to said steering mechanism; and using a functional fit over said FOV to derive a function which relates the control signals provided to said steering mechanism with the beam locations provided by said spot tracker.

44. The method of claim 43, further comprising correcting said derived function for parallax errors.

* * * * *